US007451627B2

(12) United States Patent
Horngren et al.

(10) Patent No.: US 7,451,627 B2
(45) **Date of Patent: *Nov. 18, 2008**

(54) LOCKABLE SECURITY DEVICE

(75) Inventors: Tobias Horngren, Malmo (SE); Gunnar Lindgren, Rydeback (SE)

(73) Assignee: MW Security AB, Limhamn (SE)

( * ) Notice: Subject to any disclaimer, the term of this patent is extended or adjusted under 35 U.S.C. 154(b) by 45 days.

This patent is subject to a terminal disclaimer.

(21) Appl. No.: 10/650,531

(22) Filed: Aug. 28, 2003

(65) Prior Publication Data

US 2005/0044904 A1 Mar. 3, 2005

(51) Int. Cl.
*E05B 73/00* (2006.01)

(52) U.S. Cl. ..... 70/57.1; 70/58; 70/63; 206/1.5; 206/308.2; 206/387.11

(58) Field of Classification Search ..... 70/57.1, 70/58, 57, 63; 206/1.5, 308.2, 307, 308.1, 206/387.1, 387.11
See application file for complete search history.

(56) References Cited

U.S. PATENT DOCUMENTS 5,375,712 A * 12/1994 Weisburn ..... 206/387.11
5,390,515 A * 2/1995 Essick ..... 70/57.1
5,588,315 A * 12/1996 Holmgren ..... 70/57.1
5,657,893 A * 8/1997 Hitchings ..... 70/58
5,760,689 A 6/1998 Holmgren
5,768,922 A * 6/1998 Lax ..... 70/57.1
5,934,114 A * 8/1999 Weisburn et al. ..... 70/57.1
6,082,156 A * 7/2000 Bin ..... 70/57.1
6,125,668 A * 10/2000 Belden, Jr. ..... 70/57.1
6,240,750 B1 * 6/2001 Gillespie et al. ..... 70/57.1
6,374,648 B1 * 4/2002 Mitsuyama ..... 70/57.1
6,422,387 B1 7/2002 Sedon et al.
6,430,976 B1 * 8/2002 Mitsuyama ..... 70/57.1
6,467,318 B1 10/2002 Gattiker
6,497,125 B1 12/2002 Necchi
6,516,639 B1 2/2003 Margetts et al.
6,666,330 B2 * 12/2003 Sedon et al. ..... 70/57.1
6,676,175 B2 * 1/2004 Jaeb et al. ..... 220/315
6,926,164 B1 * 8/2005 Broadhead et al. ..... 70/57.1
7,100,402 B2 * 9/2006 Holmgren ..... 70/57.1
2002/0003095 A1 * 1/2002 Jaeb et al. ..... 220/315
2003/0116455 A1 * 6/2003 Marsilio et al. ..... 206/1.5

FOREIGN PATENT DOCUMENTS

DE 35/22252 A1 1/1987

(Continued)

*Primary Examiner*—Patricia Engle
*Assistant Examiner*—Christopher Boswell
(74) *Attorney, Agent, or Firm*—Merchant & Gould P.C.

(57) ABSTRACT

Security device for holding items, comprising a first security member (10) and a second security member (100), which security members may be joined to a closed position for retaining an item, a lock slide (200) displaceable to a locked position for maintaining the security device in the closed position, and latch means (202) for maintaining the locking mechanism in the locked position, wherein said latch means form an integral part of said lock slide. The lock slide is displaceably mounted to said first security member, and said latch means comprise a spring blade (202) extending from a principal plane of said lock slide, devised to engage with cooperating means (106), arranged on said second security member, in said locked position.

27 Claims, 5 Drawing Sheets

FOREIGN PATENT DOCUMENTS

| | | |
|---|---|---|
| EP | 0 616 103 B1 | 9/1994 |
| EP | 1 285 610 | 2/2003 |
| WO | WO 00/61889 | 10/2000 |
| WO | WO 01/83325 | 11/2001 |
| WO | WO 02/042587 | 5/2002 |

* cited by examiner

LOCKABLE SECURITY DEVICE

TECHNICAL FIELD

The present invention generally relates to security devices for protecting goods from theft. In particular, the invention relates a security box comprising a base with a hinged lid, and a mechanism for securely locking said box in a closed state by means of a lock slide.

BACKGROUND

Security boxes for displaying items for sale in stores have been used for several years. In general, such boxes comprise a transparent or partly covered pivotably connected box members. These box members form a base and a lid, which are hinged together, and are generally made from plastic. In order to prevent unauthorised removal of the items contained by such security boxes, the boxes are lockable, and often hold or enclose an EAS (Electronic Article Surveillance) tag that will trigger an alarm if the EAS tag is removed from the retail establishment. The lock on the container prevents the thief from removing 30 the EAS tag or from removing the from the security box. The most common use for such security boxes is items of recorded media, such as CDs, DVDs and cassettes. Other items for which security boxes are used comprises razorblades, cosmetics, batteries and tobacco.

Many different types of security devices are known in the art, comprising lock slide mechanisms for locking the security devices, and means for maintaining the security devices in the locked position.

EP 616 103 discloses a security device design with two hinged-together box members, having a displaceable lock slide in a first box member cooperating with teeth on the other box member for locking the box members in a closed state. A locking strip, permanently attached to the first box member, is devised to engage with the lock slide for maintaining the device in a locked position.

U.S. Pat. No. 5,760,689 proposes a different design, comprising a cassette and a lid. A lock slide arranged in the lid is provided with sideways protruding lock bolts, devised to engage with the cassette for locking the container. A separate operating slide is provided for displacing the lock slide. Furthermore, a latch member is devised to maintain the lock slide in the engaged position.

WO 01/83325 discloses yet another design with a base and a lid. A lock slide is arranged in the base, movable between locked and unlocked positions. The base and the lid includes cooperating teeth which pass each other when the box is closed. The lock slide further includes teeth which are moved to a position intermediate the cooperating teeth of the base and the lid when the slide is moved to the locked position. A separate latch member is fixed to the base, devised to engage with the lock slide in the locked position.

Although security devices have been available on the market for some time, improvements may still be made. For one thing, there is a general demand from the users, most often store clerks, that the security devices are easy to handle, in terms of locking and unlocking. Furthermore, security devices for retail use are typically produced in large quantities, and a design which simplifies production is therefore a general desire.

SUMMARY OF THE INVENTION

A general object of the present invention is to provide a security device for holding items, which security device provides an improvement over the state of the art, or at least a useful choice. A first aspect of this object is to provide a security device with improved production capabilities, in terms of manufacture and assembly. Furthermore, a second aspect of this object is to provide a security device with improved operation capabilities.

According to a first aspect of the present invention, these objects are fulfilled by a security device for holding items, comprising a first security member and a second security member, which security members may be joined to a closed position for retaining an item, a lock slide displaceable to a locked position for maintaining the security device in the closed position, and latch means for maintaining the locking mechanism in the locked position, and wherein said latch means form an integral part of said lock slide. By this arrangement, fewer parts need to be included in the security device compared to prior art solutions, since a separate latch member is dispensed with. This saves time and cost both in production and in assembly Furthermore, fewer parts means less possible sources of failure and therefore a more reliable product.

In one embodiment, said lock slide is displaceably mounted to said first security member, wherein said latch means are devised to engage with cooperating means arranged on said second security member in said locked position.

Preferably, said latch means comprise a spring blade extending from a principal plane of said lock slide. Said spring blade may be devised to engage with a stop member arranged on said second security member in said locked position Said stop member may be a shoulder portion on said second security member. Alternatively, said stop member may be a recessed portion on said second security member.

Preferably, said security device comprises two or more spring blades and two or more corresponding stop members, spaced apart along said lock slide.

In a preferred embodiment, said lock slide is made from a resilient magnetic material.

Said lock slide is preferably displaceably mounted to said first security member and has a protruding tooth, said tooth engaging with a projecting tab on said second security member in said locked position.

In an alternative embodiment, said first security member has a first projecting tab, and said second security member has a second projecting tab devised to pass adjacent to said first tab when assuming said closed position, wherein said lock slide has a protruding tooth assuming a position between and at least partly overlapping said first and second tabs in said locked position.

In one embodiment, said tooth is a bent out portion of said lock slide, protruding from a principal plane of said lock slide.

The security device may include a plurality of teeth and tabs, spaced apart along said lock slide.

In one embodiment, said security members are devised to partly enclose a retained item in the closed position. Alternatively, said security members are devised to completely enclose a retained item in the closed position.

In a preferred embodiment, said security members are devised to be joined and locked to each other at respective first ends, and are hinged together at respective second ends opposite said first ends.

In an alternative embodiment, said security members are devised to be joined and locked to each other at respective first ends, and devised to be hooked together at respective second ends opposite said first ends.

In another alternative embodiment, said security members are devised to be joined and locked to each other at respective first ends, and at respective second ends opposite said first ends.

In one preferred embodiment, said first security member is a base member and said second security member is a lid member, which base and lid members form a box-like structure in said closed position. Preferably, said base member has a front wall carrying said lock slide on an inner side thereof, and said lid member has a front wall positioned on an inner side of said lock slide in said closed position. Said lid member may further have a flange projecting from the front wall thereof, which flange in said closed position engages with the front wall of said base member and encloses the lock slide in said boxlike structure.

In one embodiment, said lock slide is devised with manoeuvre means projecting through an aperture in a side portion of said first security member In a preferred embodiment, said security device comprises an alarm tag.

According to a second aspect of the present invention, the stated objects are fulfilled by a security device for holding items, comprising a first security member and a second security member, which security members may be joined to a closed position for retaining an item, a lock slide displaceable to a locked position for maintaining the security device in the closed position, and latch means for maintaining the locking mechanism in the locked position, wherein said latch means are carried on said first security member, and are devised to engage with cooperating means on said second security member. By this arrangement, the lock slide cannot be latched when the security device is in an open position, at which the latch means are disengaged from said cooperating means. This means a great improvement in the operation of the security devices since prior art solutions, such as those cited above are easily latched in the locked position by mistake even when they are open. When in the process of loading items in security boxes, such a mistake has the annoying consequence that a special tool required for unlocking and opening the security device must be used.

In one embodiment, said latch means comprises a spring blade extending from a principal plane of said lock slide.

Preferably, said latch means are integral with said lock slide.

In a preferred embodiment, said spring blade is devised to engage with a stop member arranged on said second security member in said locked position. Said stop member may be a shoulder portion on said second security member. Alternatively, said stop member may be a recessed portion on said second security member.

Preferably, said security device comprises two or more spring blades and two or more corresponding stop members, spaced apart along said lock slide.

Preferably, said latch means are made from a resilient magnetic material.

In a preferred embodiment, said security device comprises an alarm tag.

BRIEF DESCRIPTION OF THE DRAWINGS

The features and advantages of the present invention will be more apparent from the following description of the preferred embodiments with reference to the accompanying drawings, on which

DETAILED DESCRIPTION OF PREFERRED EMBODIMENTS

A first embodiment of the present invention will now be described with reference to FIGS. 1 to 6.

Figure 1:
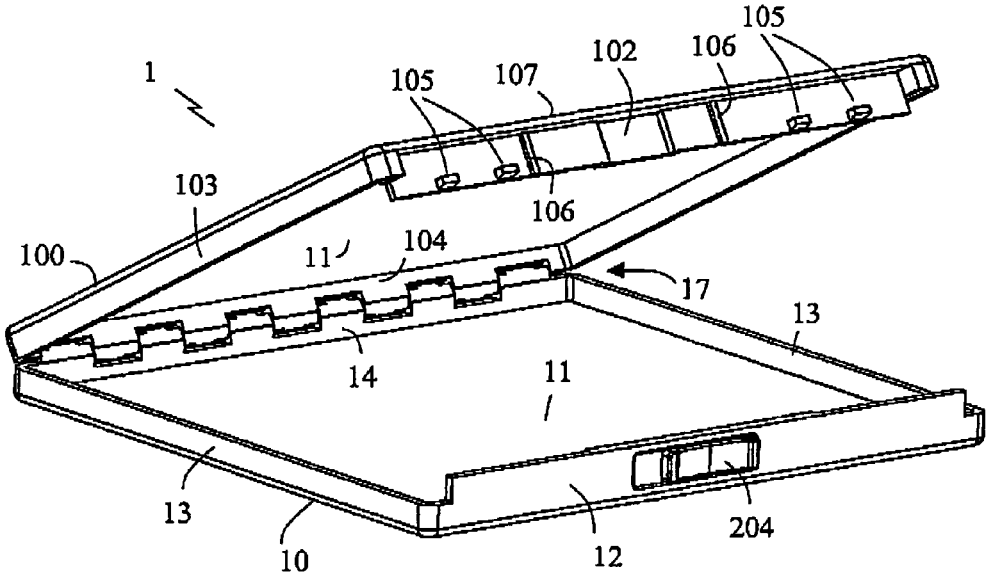
FIG. 1 is a perspective front view of a security device according to a first embodiment of the present invention in an open position.
Figure 2:
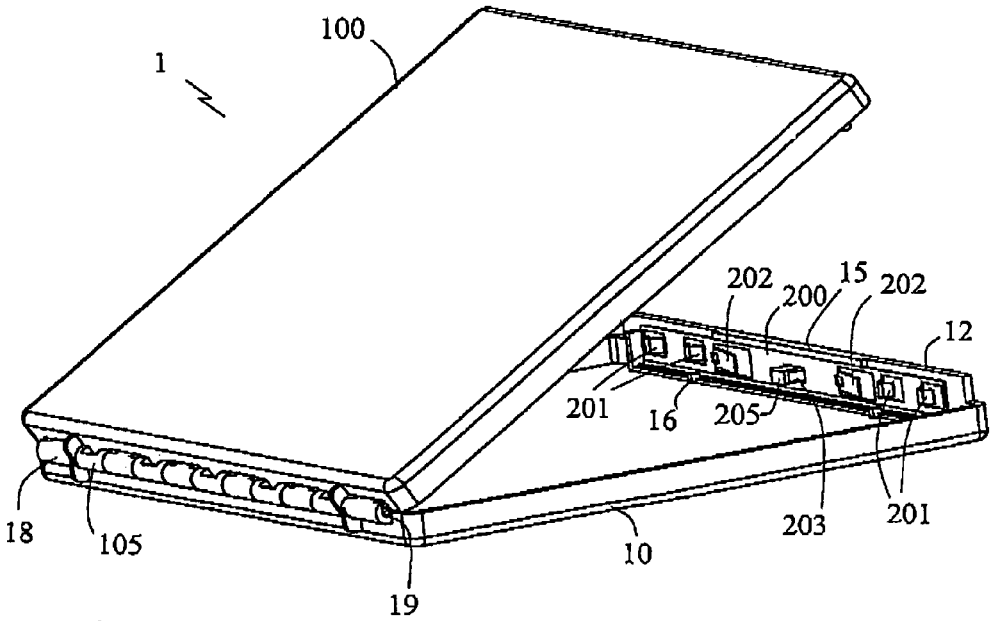
FIG. 2 is a perspective rear view of the security storage device of FIG. 1 in the open position.

FIGS. 1 and 2 illustrate a security device 1 in an open position from two different angles. Security device 1 comprises a first security member 10 and a second security member 100, and means for joining and locking said security members to each other at respective first end portions 12, 102. The security members 10, 100 are pivotably attached to each other by a hinge device 17 at respective second end portions 14, 104, opposite said first end portions 12, 102.

In the embodiment disclosed in the drawings, the first security member is a base member 10, whereas the second security member is a lid member 100. When brought together and joined, base member 10 and lid member 100 form a box-like structure defining a compartment for storing items or goods. The meaning of inner and outer, as well as inwards and outwards, used in this description relates to said compartment of the box-like structure.

Base member 10 comprises a plane wall 11, preferably made from a durable transparent plastic material, allowing consumers to view the contents of the security device. A front wall 12, a back wall 14, and side walls 13 extend substantially perpendicular from plane wall 11. Front wall 12 supports a lock slide 200, which lock slide is displaceable along an inner side of front wall 12. In one embodiment, said front wall is opaque for preventing visual access to the locking mechanism. Lid member 100 likewise comprises a plane wall 101, preferably made from a durable transparent plastic material. A front wall 102, a back wall 104, and side walls 103 extend substantially perpendicular from plane wall 101. A flange 107 projects from front wall 102 as an extension of plane wall 101, which flange 107 in the closed position engages with the front wall 12 of base member 10 and encloses the lock slide in said box-like structure.

In the illustrated embodiment, side walls 13 and 103 are devised to engage by their edges in the closed position of the security device. In an alternative embodiment, the side walls of the security members 10, 100 are devised to overlap, thereby preventing unauthorised access by inserting an object between engaged side walls. Hinge device 17 comprises at least one pair of hinge members 18, 105 attached at the respective back walls 14, 104, which hinge members are joined by a pin 19 serving as a rotation axis for hinge device 17.

Front wall 102 of lid member 100 supports outwards projecting lock tabs 105 for engagement with said lock slide 200 in the locked position of the security device. In the particular illustrated embodiment there are four lock tabs. Alternative embodiments may include any number of lock tabs 105, though, i.e. one, two or more. However, by employing a plurality of lock tabs 105 which are distributed along front wall 102 of lid member 100, as illustrated, multiple locking points are obtained which minimises the possibility of opening the security device by twisting or bending.

Figure 3:
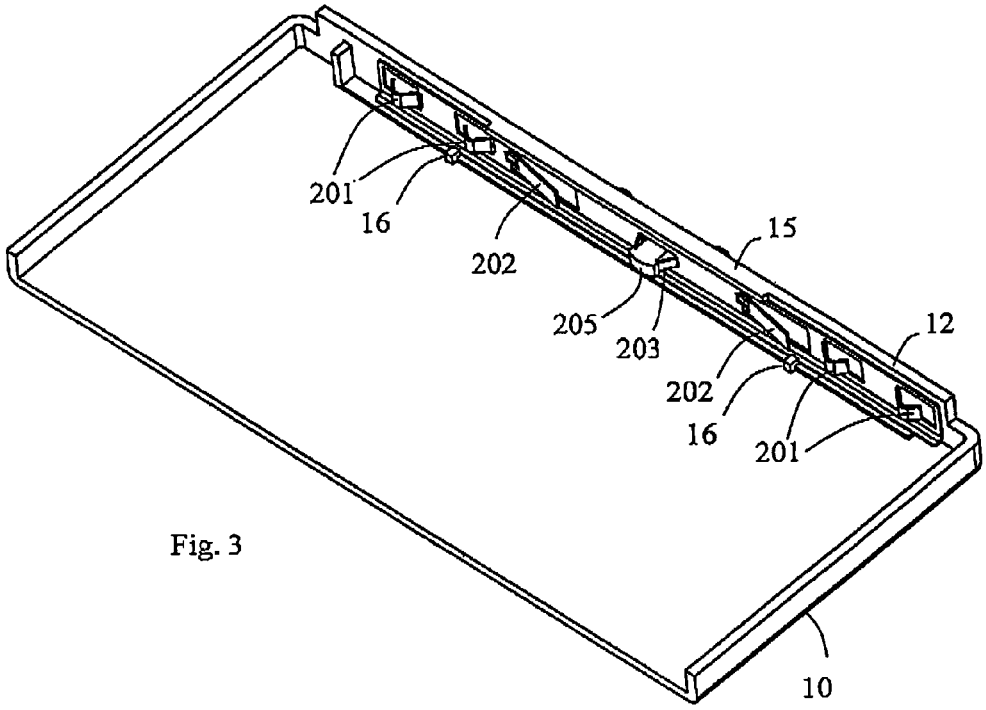
FIG. 3 is partial view of a base member of the security device of FIG. 1.

FIG. 3 illustrates lock slide 200 and a part of base member 10 of FIGS. 1 and 2 more clearly. Lock slide 200 is displaceable along front wall 12 of base member 10, and a manoeuvre member 204 is employed for this purpose. The manoeuvre member 204 is accessible through an elongated aperture formed in front wall 12, and is fixed to or forms part of lock slide 200. The illustrated embodiment comprises a separate manoeuvre member 204, arranged at the outer side of front wall 12, and which Is securely fixed to attachment means 203 in the lock slide 200 through said aperture. In this particular embodiment, attachment means 203 comprises inwards projecting flanges, which engage with a head portion 205 of manoeuvre member 204. However, in an alternative embodiment, manoeuvre member 204 may be a bent out portion of lock slide 200, which bent out portion projects through said elongated aperture. In yet another embodiment, manoeuvre member 204 may simply be a recessed portion or a through hole in lock slide 200, accessible through said elongated aperture. In the illustrated embodiment the aperture is covered by the manoeuvre member 204 in FIG. 1 and by the lock slide 200 in FIGS. 2 and 3, and is therefore not visible. However, as the skilled person realises, the elongation of said aperture extends along the front wall 12.

Lock slide 200 is made from a resilient magnetic metal material, such as steel, and extends in a principle plane parallel to front wall 12. On the inner side of lock slide 200, at least one lock tooth 201 is fixed, projecting inwards. In the illustrated embodiment, four lock teeth 201 are included, devised to engage with the four lock tabs 105 of lid member 100. As before, any number of lock teeth 201 may be employed, i.e. one two or more. In a preferred embodiment, each lock tooth 201 comprises a bent out portion of said lock slide 200. The lock slide may be bent out over its entire height. However, in the preferred and illustrated embodiment, said bent out portion is a cut-out tongue 201 which is fixed at one end to the principal plane of lock slide 200, and which extends in the elongation of lock slide 200. Teeth 201 are devised to lock the security device by sideways displacing the lock slide 200, when the security device 1 is closed, to a locked position where teeth 201 are placed over lock tabs 105, as will be described below.

Once manoeuvre member 204 is attached to lock slide 200 through the aperture of front wall 12, the lock slide 200 is secured to the base member 10. However, in order to reinforce the security device, front wall 12 of base member 10 comprises an upper edge portion 16, projecting inwards over lock slide 200, thereby preventing the same from moving upwards and away from plane wall 11. Furthermore, guide shoulders 16 are preferably arranged at the lower end of front wall 12.

In order to maintain the security device 1 in the locked position, latch means are provided in the form of at least one spring blade 202 which is integral with the lock slide 200. Spring blade 202 is biased to project inwards and sideways at an angle from the principle plane of lock slide 200. One single spring blade 202 may be sufficient, though in the presented embodiments two spaced apart spring blades 202 are included.

As is evident from FIG. 1, front wall 102 of lid member 100 further includes stop members 106, devised to engage with spring blades 202 when the security device 1 is closed and locked. Said stop members are, in the illustrated embodiment, provided by protruding shoulders 106 extending perpendicular to the displacement direction of lock slide 200. An alternative solution is to provide a recess in front wall 102.

Figure 4:
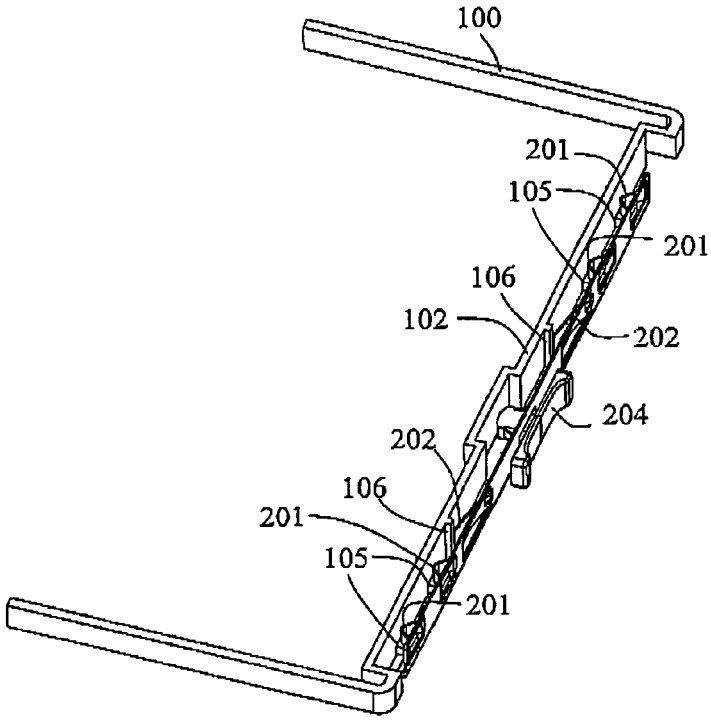
FIG. 4 illustrates the lid member engaged with the lock slide of the base member, of the embodiment of FIG. 1.

FIG. 4 illustrates the lock slide 200, which is supported by the left out base member 10, and apart of the lid member 100 with plane wall 101 left out, in the closed and locked position. Lock teeth 201 are positioned over lock tabs 105, preventing lid member 100 from being disengaged from base member 10. Furthermore, each spring blade 202 has automatically, by means of its resiliency, assumed a position with its outer edge engaged behind stop edge 106, thereby preventing the lock slide 200 from being moved to an unlocked position.

In order to unlock the latched security device 1, a special tool is required. For the embodiment of FIG. 1, such a special tool must include a magnet which is powerful enough to attract spring blades 202 towards the principle plane of lock slide 200, in a manner well known in the prior art. Preferably, the special tool comprises one magnet for each spring blade, which magnets are distributed along a surface of the tool with the same spacing as between said spring blades 202. Furthermore, manoeuvre engagement means are preferably included in the special tool, devised to engage with manoeuvre member 204 when applied correctly.

Figure 5:
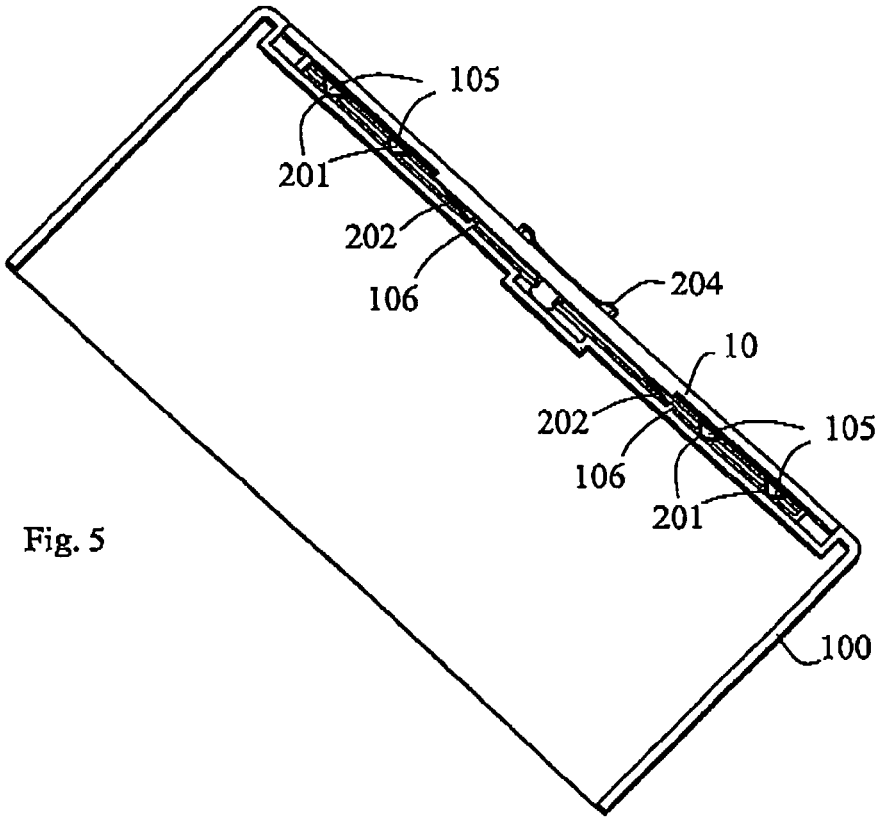
FIG. 5 illustrates a top view of the security device of FIG. 1 in a locked and latched position.

FIG. 5 illustrates the embodiment of FIG. 1 with plane wall 101 of lid member 100 left out, in its locked position with teeth 201 arranged over tabs 105, and spring blades 202 engaged behind shoulders 106. A special tool (not shown), designed for this particular type of security devices, is engaged with manoeuvre member 204, whereby magnets of the special tool are automatically placed above the corresponding spring blades 202. The spring blades 202 are thus attracted by the magnets, at least to an extent where the outer ends of the spring blades 202 are raised over shoulders 106.

Figure 6:
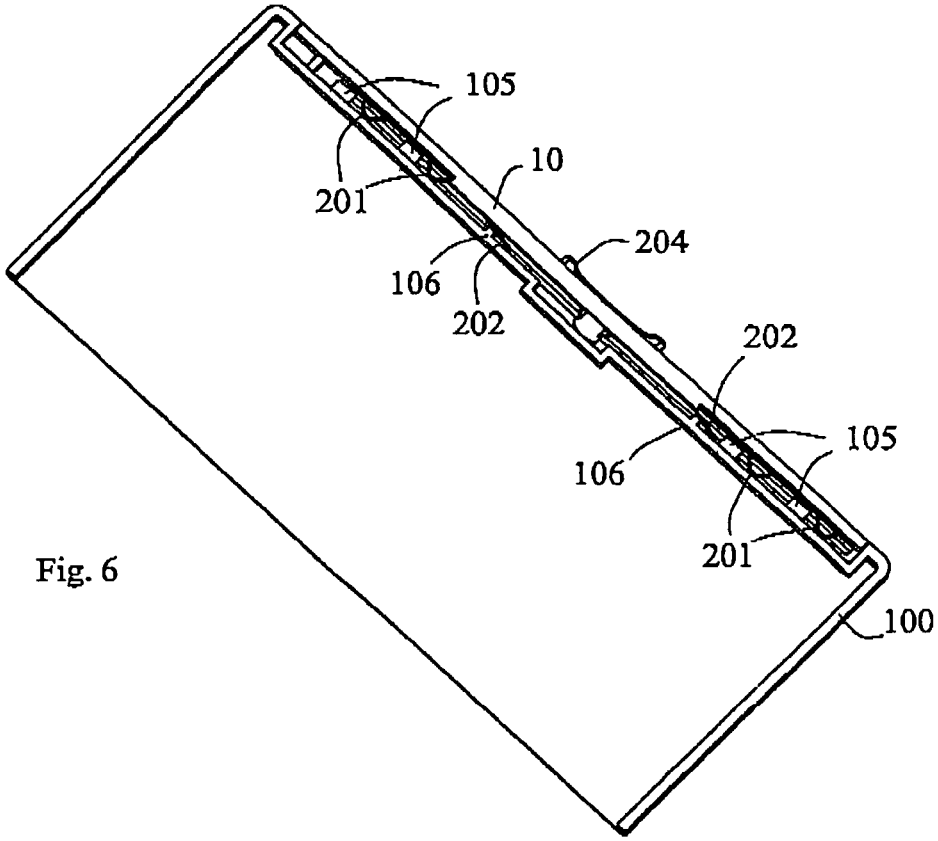
FIG. 6 illustrates a top view of the security device of FIG. 1 in an unlocked position.

FIG. 6 further illustrates how security device 1 is displaced sideways relative to the special tool, whereby the special tool pulls lock slide 200 by manoeuvre member 204, such that teeth 201 are disengaged from tabs 105 The security device is now unlocked and may be opened.

Figure 7:
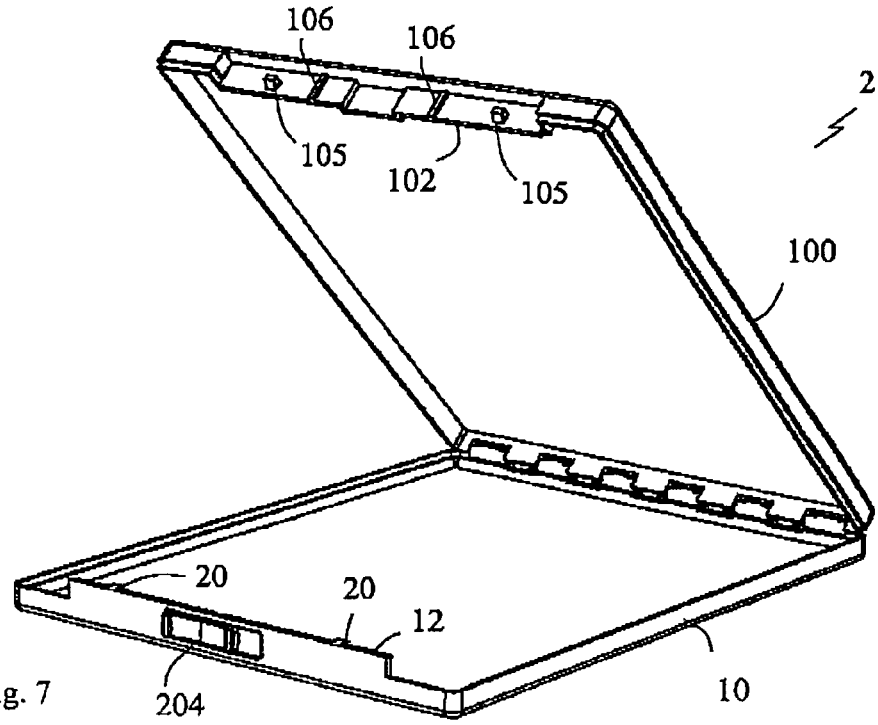
FIG. 7 is a perspective front view of a security device according to a second embodiment of the present invention in an open position.
Figure 8:
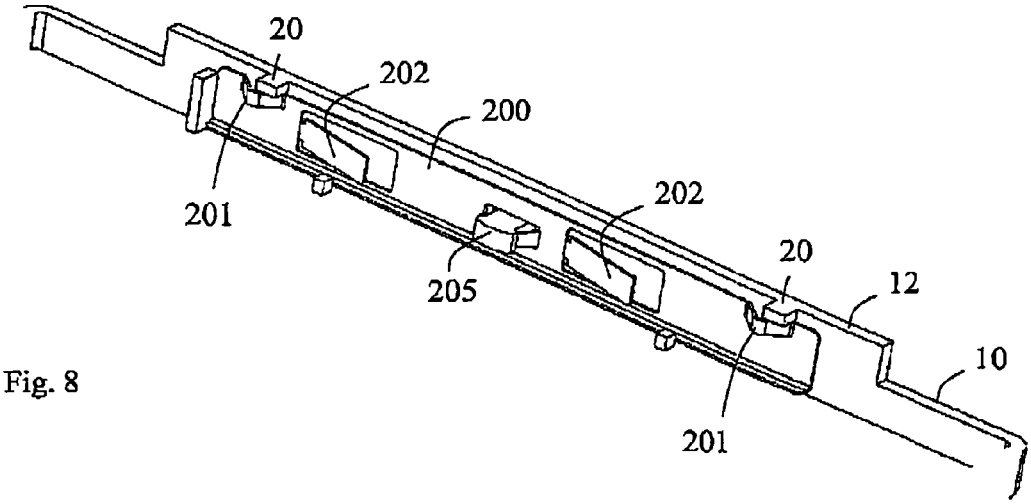
FIG. 8 is partial view of a base member of the security device of FIG. 7.
Figure 9:
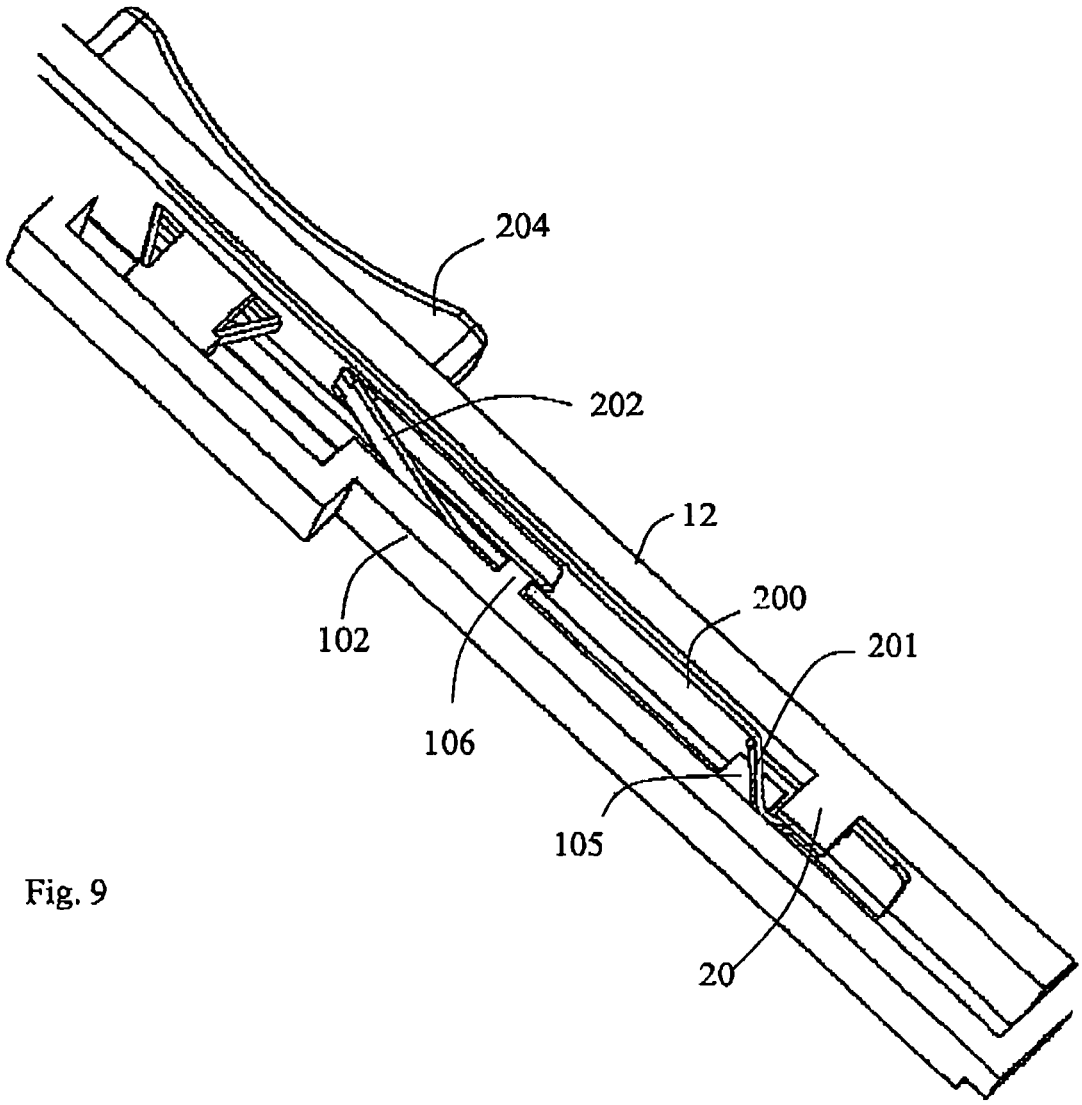
FIG. 9 illustrates a partial top view of the security device of FIG. 7 in a locked and latched position.

A second embodiment of the present invention is illustrated in FIGS. 7 to 9. This second embodiment is in many ways identical to the first embodiment, and the same reference numerals are therefore used for corresponding elements.

FIG. 7 illustrates a security device 2 in an open position. Two first lock tabs 105 project from front wall 102 of lid member 100. Front wall 102 is also devised with shoulder members 106, for engagement with latch means on a lock slide 200 displaceably arranged on base member 10. Furthermore, front wall 12 of base member 10 has two second lock tabs 20 projecting inwardly, i.e. in the opposite direction of first tabs 105. First and second lock tabs are offset to each other, such that when the lid member 100 is closed, first tabs 105 are brought passed second tabs 20.

FIG. 8 illustrates a part of base member 10 as seen from the inside, revealing lock slide 200 which is made from a resilient magnetic metal material, such as steel. Lock slide 200 is devised wit teeth: 201 and latch means 202 in the form of spring blades, as in the previous embodiment. Manoeuvre member 204 is attached to lock slide 200 through an elongated aperture in front wall 12. One difference from the previous embodiment is that teeth 201 are disposed immediately under second tabs 20, though sideways displaceable in relation to said second tabs 20.

FIG. 9, finally, illustrates a cut-out portion of the closed and latched embodiment of the security device of FIG. 7, leaving out the plane wall of lid member 100. Front wall 102 is disposed inwardly of lock slide 200, and first tabs 105 are located beside and under second tabs 20. Lock slide 200 has been displaced to a position at which tooth 201 is placed between said first 105 and second 20 tabs, thus preventing the security device 2 from being opened. Furthermore, spring blade 202 is latched into engagement with shoulder member 106, preventing the lock slide from leaving the illustrated locked positioned By applying a special tool comprising a magnet against front wall 12, spring blade 201 may be attracted to be disengaged from shoulder member 106, where after lock slide 200 may be moved to he right in the drawing. This way, first tabs 105 are disengaged and the security device 2 may be opened.

The present invention provides a simplified design compared to the prior art, with an integrated element 200 comprising both lock slide 200 and latch means 202, wherefore fewer parts are needed in the security device. Furthermore, by arranging the latching function to include engagement between latch means 202 attached to one security member 10 with a cooperating member 106 on the other security member 100, improved handling is obtained since the security device cannot be latched in an open position. The security device according to the invention may be used for storing recorded media such as a CD or DVD jewel box, or other items such as razor blades or other goods. In fact, the invention is in no way restricted to any type of item to be retained. Furthermore, it is not essential that the security members form a box-like structure, they may just as well form a clamp-like structure devised to be placed about an elongated item, such as a bottleneck, a bicycle frame etc. Also, the two security members do not have to be hinged together. An alternative solution is to provide a hook-like engagement at the end portion opposing the end portion carrying the lock mechanism. Yet another possibility is to provide lock mechanisms at both end portions.

It should therefore be noted that the description and illustration of the invention is by way of example, and that the scope of the invention is not limited to the exact details shown or described.

The invention claimed is:

1. Security device for holding items, comprising:

a first security member, and a second security member, wherein the first and second security members are engaged at a closed position for retaining an item, a lock slide mounted to the first security member and displaceable while remaining mounted to the first security member between an unlocked position wherein the security device can be opened and a locked position for maintaining the security device in the closed position, and a latch including a spring blade configured to engage with a stop member for maintaining the lock slide in the locked position, wherein the lock slide comprises a resilient magnetic material, the spring blade forms an integral part of the lock slide, and the stop member is arranged on the second security member.

2. The security device of claim 1, wherein the spring blade extends from a principal plane of said lock slide.

3. The security device of claim 2, wherein said spring blade is configured to engage the stop member in said locked position.

4. The security device of claim 3, wherein said stop member is a shoulder portion on said second security member.

5. The security device of claim 3, wherein said stop member is a recessed portion on said second security member.

6. The security device of claim 3, comprising two or more spring blades and two or more corresponding stop members spaced apart along said lock slide.

7. The security device of claim 1, wherein said lock slide has a protruding tooth, wherein said tooth engages with a projecting tab on said second security member in said locked position.

8. The security device of claim 7, wherein said tooth is a bent out portion of said lock slide protruding from a principal plane of said lock slide.

9. The security device of claim 7, wherein a plurality of teeth and tabs are provided spaced apart along said lock slide.

10. The security device of claim 1, wherein said first security member has a first projecting tab, and said second security member has a second projecting tab, wherein said second projecting tab passes adjacent to said first tab when assuming said closed position, wherein said lock slide has a protruding tooth assuming a position between and at least partly overlapping said first and second tabs in said locked position.

11. The security device of claim 1, wherein said security members are configured to partly enclose a retained item in the closed position.

12. The security device of claim 1, wherein said security members are configured to completely enclose a retained item in the closed position.

13. The security device of claim 1, wherein said security members are joined and locked to each other at respective first ends, and are hinged together at respective second ends opposite said first ends.

14. The security device of claim 1, wherein said security members are joined and locked to each other at respective first ends, and devised to be hooked together at respective second ends opposite said first ends.

15. The security device of claim 1, wherein said security members are joined and locked to each other at respective first ends, and at respective second ends opposite said first ends.

16. The security device of claim 1, wherein said first security member is a base member and said second security member is a lid member, wherein said base and lid members form a box-like structure in said closed position.

17. The security device of claim 16, wherein said base member has a front wall carrying said lock slide on an inner side thereof, and said lid member has a front wall positioned on an inner side of said lock slide in said locked position.

18. The security device of claim 17, wherein said lid member has a flange projecting from the front wall thereof, wherein said flange in said closed position engages with the front wall of said base member and encloses the lock slide in said box-like structure.

19. The security device of claim 1, wherein said lock slide further comprises a maneuver member projecting through an aperture in a side portion of said first security member.

20. The security device of claim 1, the device further comprising an alarm tag.

21. Security device for holding items, comprising:

a first security member, and a second security member including a stop member, wherein the first and second security members are engaged at a closed position for retaining an item, a lock slide mounted to the first security member and displaceable while remaining mounted to the first security member between an unlocked position wherein the security device can be opened and a locked position for maintaining the security device in the closed position, and a latch for maintaining the lock slide in the locked position, wherein said latch is carried on said first security member, and is configured to engage with the stop member in said locked position, wherein said latch comprises a spring blade extending from a principal plane of said lock slide, and said spring blade is configured to engage with the stop member in said locked position.

22. The security device of claim 21, wherein said latch is integral with said lock slide.

23. The security device of claim 21, comprising two or more spring blades and two or more corresponding stop members spaced apart along said lock slide.

24. The security device of claim 21, wherein said stop member is a shoulder portion on said second security member.

25. The security device of claim 21, wherein said stop member is a recessed portion on said second security member.

26. The security device of claim 21, the device further comprising an alarm tag.

27. The security device of claim 21 wherein said latch comprises a resilient magnetic material.

* * * * *